US008904727B1

(12) United States Patent
Hohmann, Jr.

(10) Patent No.: US 8,904,727 B1
(45) Date of Patent: Dec. 9, 2014

(54) HIGH-STRENGTH VERTICALLY COMPRESSED VENEER TIE ANCHORING SYSTEMS UTILIZING AND THE SAME

(71) Applicant: Mitek Holdings, Inc., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 14/054,145

(22) Filed: Oct. 15, 2013

(51) Int. Cl.
*E04B 1/16* (2006.01)
*E04B 2/06* (2006.01)

(52) U.S. Cl.
CPC ..... *E04B 2/06* (2013.01)
USPC ..... 52/379; 52/513; 52/712; 52/713

(58) Field of Classification Search
USPC ..... 52/378–380, 383, 513, 410, 508–509, 52/426, 428, 434, 474, 712–714, 565, 568, 52/699
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| RE15,979 | E | 1/1925 | Schaefer et al. |
| 1,794,684 | A | 3/1931 | Handel |
| 1,936,223 | A | 11/1933 | Awbrey |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |
| 2,413,772 | A | 1/1947 | Morehouse |
| 2,605,867 | A | 8/1952 | Goodwin |
| 2,780,936 | A | 2/1957 | Hillberg |

(Continued)

FOREIGN PATENT DOCUMENTS

| | | |
|---|---|---|
| CH | 279209 | 3/1952 |
| EP | 0199595 B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brian Glessner
*Assistant Examiner* — Beth Stephan
(74) *Attorney, Agent, or Firm* — Silber & Fridman

(57) ABSTRACT

An anchoring system for cavity walls is disclosed and includes a wall anchor and a high-strength partially compressed veneer tie. The anchor preserves the insulation integrity by sealing the insertion points in the inner wythe. The veneer tie utilizes ribbon cavity portions that are cold-worked and vertically compressed, with the resultant body having substantially semicircular edges and flat surfaces therebetween. The edges are aligned to receive compressive forces transmitted from the outer wythe. The veneer tie, when part of the anchoring system, interengages with the wall anchor and is dimensioned to preclude significant veneer tie movement, preclude pullout and shed moisture and mortar within the cavity.

20 Claims, 8 Drawing Sheets

(56) References Cited

U.S. PATENT DOCUMENTS

| | | | |
|---|---|---|---|
| 2,898,758 | A | 8/1959 | Henrickson |
| 2,929,238 | A | 3/1960 | Kaye |
| 2,966,705 | A | 1/1961 | Massey |
| 2,999,571 | A | 9/1961 | Huber |
| 3,030,670 | A | 4/1962 | Bigelow |
| 3,183,628 | A | 5/1965 | Smith |
| 3,254,736 | A | 6/1966 | Gass |
| 3,277,626 | A | 10/1966 | Brynjolfsson et al. |
| 3,300,939 | A | 1/1967 | Brynjolfsson et al. |
| 3,309,828 | A | 3/1967 | Tribble |
| 3,310,926 | A | 3/1967 | Brandreth et al. |
| 3,341,998 | A | 9/1967 | Lucas |
| 3,377,764 | A | 4/1968 | Storch |
| 3,478,480 | A | 11/1969 | Swenson |
| 3,563,131 | A | 2/1971 | Ridley, Sr. |
| 3,568,389 | A | 3/1971 | Gulow |
| 3,640,043 | A | 2/1972 | Querfeld et al. |
| 3,964,226 | A | 6/1976 | Hala et al. |
| 3,964,227 | A | 6/1976 | Hala |
| 4,021,990 | A | 5/1977 | Schwalberg |
| 4,227,359 | A | 10/1980 | Schlenker |
| 4,238,987 | A | 12/1980 | Siebrecht-Reuter |
| 4,305,239 | A | 12/1981 | Geraghty |
| 4,373,314 | A | 2/1983 | Allan |
| 4,382,416 | A | 5/1983 | Kellogg-Smith |
| 4,424,745 | A | 1/1984 | Magorian et al. |
| 4,438,611 | A | 3/1984 | Bryant |
| 4,473,984 | A | 10/1984 | Lopez |
| 4,482,368 | A | 11/1984 | Roberts |
| 4,571,909 | A | 2/1986 | Berghuis et al. |
| 4,596,102 | A | 6/1986 | Catani et al. |
| 4,598,518 | A | 7/1986 | Hohmann |
| 4,606,163 | A | 8/1986 | Catani |
| 4,622,796 | A | 11/1986 | Aziz et al. |
| 4,628,657 | A | 12/1986 | Ermer et al. |
| 4,636,125 | A | 1/1987 | Burgard |
| 4,640,848 | A | 2/1987 | Cerdan-Diaz et al. |
| 4,660,342 | A | 4/1987 | Salisbury |
| 4,703,604 | A | 11/1987 | Muller |
| 4,708,551 | A | 11/1987 | Richter et al. |
| 4,738,070 | A | 4/1988 | Abbott et al. |
| 4,764,069 | A | 8/1988 | Reinwall et al. |
| 4,819,401 | A | 4/1989 | Whitney, Jr. |
| 4,827,684 | A | 5/1989 | Allan |
| 4,843,776 | A | 7/1989 | Guignard |
| 4,852,320 | A | 8/1989 | Ballantyne |
| 4,869,038 | A | 9/1989 | Catani |
| 4,869,043 | A | 9/1989 | Hatzinikolas et al. |
| 4,875,319 | A | 10/1989 | Hohmann |
| 4,911,949 | A | 3/1990 | Iwase et al. |
| 4,922,680 | A | 5/1990 | Kramer et al. |
| 4,946,632 | A | 8/1990 | Pollina |
| 4,955,172 | A | 9/1990 | Pierson |
| 5,063,722 | A | 11/1991 | Hohmann |
| 5,099,628 | A | 3/1992 | Noland et al. |
| 5,207,043 | A | 5/1993 | McGee et al. |
| 5,307,602 | A | 5/1994 | Lebraut |
| 5,392,581 | A | 2/1995 | Hatzinikolas et al. |
| 5,408,798 | A | 4/1995 | Hohmann |
| 5,440,854 | A | 8/1995 | Hohmann |
| 5,454,200 | A | 10/1995 | Hohmann |
| 5,456,052 | A | 10/1995 | Anderson et al. |
| 5,490,366 | A | 2/1996 | Burns et al. |
| 5,598,673 | A | 2/1997 | Atkins |
| 5,634,310 | A | 6/1997 | Hohmann |
| 5,669,592 | A | 9/1997 | Kearful |
| 5,671,578 | A | 9/1997 | Hohmann |
| 5,673,527 | A | 10/1997 | Coston et al. |
| 5,755,070 | A | 5/1998 | Hohmann |
| 5,816,008 | A | 10/1998 | Hohmann |
| 5,819,486 | A | 10/1998 | Goodings |
| 5,845,455 | A | 12/1998 | Johnson, III |
| 6,000,178 | A | 12/1999 | Goodings |
| 6,125,608 | A | 10/2000 | Charlson |
| 6,209,281 | B1 | 4/2001 | Rice |
| 6,279,283 | B1 | 8/2001 | Hohmann et al. |
| 6,284,311 | B1 | 9/2001 | Gregorovich et al. |
| 6,332,300 | B1 | 12/2001 | Wakai |
| 6,351,922 | B1 | 3/2002 | Burns et al. |
| 6,367,219 | B1 | 4/2002 | Quinlan |
| 6,612,343 | B2 | 9/2003 | Camberlin et al. |
| 6,627,128 | B1 | 9/2003 | Boyer |
| 6,668,505 | B1 | 12/2003 | Hohmann et al. |
| 6,686,301 | B2 | 2/2004 | Li et al. |
| 6,735,915 | B1 | 5/2004 | Johnson, III |
| 6,739,105 | B2 | 5/2004 | Fleming |
| 6,789,365 | B1 | 9/2004 | Hohmann et al. |
| 6,817,147 | B1 | 11/2004 | MacDonald |
| 6,827,969 | B1 | 12/2004 | Skoog et al. |
| 6,837,013 | B2 | 1/2005 | Foderberg et al. |
| 6,851,239 | B1 | 2/2005 | Hohmann et al. |
| 6,925,768 | B2 | 8/2005 | Hohmann et al. |
| 6,941,717 | B2 | 9/2005 | Hohmann et al. |
| 6,968,659 | B2 | 11/2005 | Boyer |
| 7,007,433 | B2 | 3/2006 | Boyer |
| 7,017,318 | B1 | 3/2006 | Hohmann et al. |
| 7,043,884 | B2 | 5/2006 | Moreno |
| 7,059,577 | B1 | 6/2006 | Burgett |
| D527,834 | S | 9/2006 | Thimons |
| 7,147,419 | B2 | 12/2006 | Balbo Di Vinadio |
| 7,152,382 | B2 | 12/2006 | Johnson, III |
| 7,171,788 | B2 | 2/2007 | Bronner |
| 7,178,299 | B2 | 2/2007 | Hyde et al. |
| D538,948 | S | 3/2007 | Thimons et al. |
| 7,225,590 | B1 | 6/2007 | diGirolamo et al. |
| 7,325,366 | B1 | 2/2008 | Hohmann, Jr. et al. |
| 7,334,374 | B2 | 2/2008 | Schmid |
| 7,374,825 | B2 | 5/2008 | Hazel et al. |
| 7,415,803 | B2 | 8/2008 | Bronner |
| 7,469,511 | B2 | 12/2008 | Wobber |
| 7,481,032 | B2 | 1/2009 | Tarr |
| 7,552,566 | B2 | 6/2009 | Hyde et al. |
| 7,562,506 | B2 | 7/2009 | Hohmann, Jr. |
| 7,587,874 | B2 | 9/2009 | Hohmann, Jr. |
| 7,735,292 | B2 | 6/2010 | Massie |
| 7,748,181 | B1 | 7/2010 | Guinn |
| 7,788,869 | B2 | 9/2010 | Voegele, Jr. |
| D626,817 | S | 11/2010 | Donowho et al. |
| 7,845,137 | B2 | 12/2010 | Hohmann, Jr. |
| 8,037,653 | B2 | 10/2011 | Hohmann, Jr. |
| 8,051,619 | B2 | 11/2011 | Hohmann, Jr. |
| 8,096,090 | B1 | 1/2012 | Hohmann, Jr. et al. |
| 8,109,706 | B2 | 2/2012 | Richards |
| 8,122,663 | B1 | 2/2012 | Hohmann, Jr. et al. |
| 8,201,374 | B2 | 6/2012 | Hohmann, Jr. |
| 8,209,934 | B2 | 7/2012 | Pettingale |
| 8,215,083 | B2 | 7/2012 | Toas et al. |
| 8,291,672 | B2 | 10/2012 | Hohmann, Jr. |
| 8,347,581 | B2 | 1/2013 | Doerr et al. |
| 8,375,667 | B2 | 2/2013 | Hohmann, Jr. |
| 8,418,422 | B2 | 4/2013 | Johnson, III |
| 8,511,041 | B2 | 8/2013 | Fransen |
| 8,516,763 | B2 | 8/2013 | Hohmann, Jr. |
| 8,516,768 | B2 | 8/2013 | Johnson, III |
| 8,544,228 | B2 | 10/2013 | Bronner |
| 8,555,587 | B2 | 10/2013 | Hohmann, Jr. |
| 8,555,596 | B2 | 10/2013 | Hohmann, Jr. |
| 8,596,010 | B2 | 12/2013 | Hohmann, Jr. |
| 8,613,175 | B2 | 12/2013 | Hohmann, Jr. |
| 8,667,757 | B1 | 3/2014 | Hohmann, Jr. |
| 2001/0054270 | A1 | 12/2001 | Rice |
| 2002/0100239 | A1 | 8/2002 | Lopez |
| 2003/0121226 | A1 | 7/2003 | Bolduc |
| 2003/0217521 | A1 | 11/2003 | Richardson et al. |
| 2004/0083667 | A1 | 5/2004 | Johnson, III |
| 2004/0216408 | A1 | 11/2004 | Hohmann, Jr. |
| 2004/0216413 | A1 | 11/2004 | Hohmann et al. |
| 2004/0216416 | A1 | 11/2004 | Hohmann et al. |
| 2004/0231270 | A1 | 11/2004 | Collins et al. |
| 2005/0279043 | A1 | 12/2005 | Bronner |
| 2006/0005490 | A1* | 1/2006 | Hohmann ..... 52/293.3 |
| 2006/0198717 | A1 | 9/2006 | Fuest |
| 2006/0242921 | A1 | 11/2006 | Massie |
| 2006/0251916 | A1 | 11/2006 | Arikawa et al. |

(56) References Cited

U.S. PATENT DOCUMENTS

| | | | | |
|---|---|---|---|---|
| 2008/0092472 | A1 | 4/2008 | Doerr et al. | |
| 2008/0141605 | A1 | 6/2008 | Hohmann | |
| 2008/0222992 | A1 | 9/2008 | Hikai et al. | |
| 2009/0133351 | A1 * | 5/2009 | Wobber | 52/565 |
| 2009/0133357 | A1 | 5/2009 | Richards | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0277397 | A1 | 11/2011 | Hohmann, Jr. | |
| 2012/0186183 | A1 | 7/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |

FOREIGN PATENT DOCUMENTS

| | | |
|---|---|---|
| GB | 1575501 | 9/1980 |
| GB | 2069024 A | 8/1981 |
| GB | 2246149 A | 1/1992 |
| GB | 2265164 A | 9/1993 |
| GB | 2459936 B | 3/2013 |

OTHER PUBLICATIONS

Building Envelope Requirements for Commercial and High Rise Residential Buildings, 780 CMR sec. 1304.0 et seq. of Chapter 13, Jan. 1, 2001, 19 pages, Boston, Massachusetts, United States.

Hohmann & Barnard, Inc.; Product Catalog, 2013, 52 pages, Hauppauge, New York, United States.

Effect of Insulation and Mass Distribution in Exterior Walls on Dynamic Thermal Performance of Whole Buildings, Jan Kosny, Ph.D, Elisabeth Kossecka, Ph.D., Thermal Envelopes VII/Building Systems—Principles p. 721-731, 11 pages.

ASTM Standard A-951, Standard Specification for Steel Wire for Masonry Joint Reinforcement, Nov. 14, 2011, Table 1, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Product Catalog, 44 pgs (2003).

Building Code Requirements for Masonry Structures and Commentary, TMS 402-1/ACI 530-11/ASCE 5-11, 2011, Chapter 6, 12 pages.

* cited by examiner

HIGH-STRENGTH VERTICALLY COMPRESSED VENEER TIE ANCHORING SYSTEMS UTILIZING AND THE SAME

BACKGROUND OF THE INVENTION

1. Field of the Invention

This invention relates to an improved anchoring arrangement for use in conjunction with cavity walls. More particularly, the invention relates to construction accessory devices, namely, veneer ties with vertically compressed cavity portions, and a sealing anchoring system for insulated cavity walls. The invention is applicable to structures having an outer wythe of brick or stone facing in combination with an inner wythe of either masonry block or dry wall construction. The system has application to non-seismic and seismic-resistant structures.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer. Anchors and ties are generally placed in one of the following five categories: corrugated; sheet metal; wire; two-piece adjustable; or joint reinforcing. The present invention has a focus on wire formative veneer ties.

Prior tests have shown that failure of anchoring systems frequently occurs at the portion of the veneer tie that lies within the cavity. The prior art veneer tie cavity sections often retain stray mortar and moisture within the cavity. The vertical (north-south) compression of the veneer tie cavity portion strengthens the cavity portion and causes a shedding of the excess mortar and moisture retained on the prior art veneer ties. This invention addresses the need for a high-strength veneer tie interconnection suitable for use with both a masonry block or dry wall construction and provides a tie-to-receptor connection.

In the late 1980's, surface-mounted wall anchors were developed by Hohmann & Barnard, Inc., now a MiTek-Berkshire Hathaway company, patented under U.S. Pat. No. 4,598,518 ('518). This invention was commercialized under trademarks DW-10®, DW-10-X®, and DW-10-HS®. These widely accepted building specialty products were designed primarily for drywall construction, but were also used with masonry backup walls. For seismic applications, it was common practice to use these wall anchors as part of the DW-10 Seismiclip® interlock system which added a Byna-Tie® wire formative, a Seismiclip® snap-in device—described in U.S. Pat. No. 4,875,319 ('319), and continuous wire reinforcement.

In the dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max). The interlock system served well and received high scores in testing and engineering evaluations which examined the effects of various forces, particularly lateral forces, upon brick veneer masonry construction. However, under certain conditions, the system did not sufficiently maintain the integrity of the insulation.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the building code provisions. The use of a continuous wire in masonry veneer walls has also been found to provide protection against problems arising from thermal expansion and contraction and to improve the uniformity of the distribution of lateral forces in the structure.

Exemplary of the public sector building specification is that of the Energy Code Requirement, Boston, Mass. (see Chapter 13 of 780 CMR, Seventh Edition). This code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

Shortly after the introduction of the pronged wall anchor, a seismic veneer anchor, which incorporated an L-shaped backplate, was introduced. This was formed from either 12- or 14-gage sheetmetal and provided horizontally disposed openings in the arms thereof for pintle legs of the veneer anchor. In general, the pintle-receiving sheetmetal version of the Seismiclip® interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for disposition in a bed joint of the outer wythe. It is instructive to note that pin-point loading—that is forces concentrated at substantially a single point—developed from this design configuration. Upon experiencing lateral forces over time, this resulted in the loosening of the stud.

In the past, the use of wire formatives have been limited by the mortar layer thickness which, in turn are dictated either by the new building specifications or by pre-existing conditions, e.g. matching during renovations or additions to the existing mortar layer thickness. While arguments have been made for increasing the number of the fine-wire anchors per unit area of the facing layer, architects and architectural engineers have favored wire formative anchors of sturdier wire.

Contractors found that heavy wire anchors, with diameters approaching the mortar layer height specification, frequently result in misalignment. This led to the low-profile wall anchors of the inventors hereof as described in U.S. Pat. No. 6,279,283. However, the above-described technology did not fully address the adaption thereof to insulated inner wythes utilizing stabilized stud-type devices.

As insulation became thicker, the tearing of insulation during installation of the pronged DW-10X wall anchor, see supra, became more prevalent. This occurred as the installer would fully insert one side of the wall anchor before seating the other side. The tearing would occur during the arcuate path of the insertion of the second leg. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater retention of insulation integrity and less reliance on a patch.

The high-strength veneer tie of this invention is specially configured to prevent veneer tie failure and resultant pullout. The configured tie restricts movement in all directions, ensuring a high-strength connection and transfer of forces between the veneer and the backup wall. The wire formative cavity portions are compressively reduced in height by the cold-working thereof to increase the veneer tie strength. Because the wire formative hereof employs extra strong material and benefit from the cold-working of the metal alloys, the high-span anchoring system meets the unusual requirements demanded in current building structures. Reinforcement wires are included to form seismic constructs.

The following patents are believed to be relevant and are disclosed as being known to the inventor hereof:

| U.S. Pat. No. | Inventor | Issue Date |
|---|---|---|
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,875,319 | Hohmann | Oct. 24, 1989 |
| 5,456,052 | Anderson et al. | Oct. 10, 1995 |
| 6,209,281 | Rice | Apr. 13, 2001 |
| 6,279,283 | Hohmann et al | Aug. 28, 2001 |
| 6,851,239 | Hohmann et al | Feb. 8, 2005 |
| 7,017,318 | Hohmann | Mar. 28, 2006 |
| 7,325,366 | Hohmann, Jr., et al. | Feb. 5, 2008 |

U.S. Pat. No. 4,021,990-Schwalberg-Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314-Allan-Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984-Lopez-Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518-Hohmann-Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,875,319-Hohmann-Issued Oct. 24, 1989 Discloses a seismic construction system for anchoring a facing veneer to wallboard/metal stud construction with a pronged sheetmetal anchor. The wall tie is distinguished over that of Schwalberg '990 and is clipped onto a straight wire run.

U.S. Pat. No. 5,456,052-Anderson et al.-Issued Oct. 10, 1995 Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 6,209,281-Rice-Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283-Hohmann et al.-Issued Aug. 28, 2001 Discloses a low-profile wall tie primarily for use in renovation construction where in order to match existing mortar height in the facing wythe a compressed wall tie is embedded in the bed joint of the brick veneer.

U.S. Pat. No. 6,851,239-Hohmann et al.-Issued Feb. 8, 2005 Discloses a high-span anchoring system described for a cavity wall incorporating a wall reinforcement combined with a wall tie, which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318-Hohmann, et al.-Issued Mar. 28, 2006 Discloses an anchoring system with low-profile wall ties in which insertion portions of the wall anchor and the veneer anchor are compressively reduced in height.

U.S. Pat. No. 7,325,366-Hohmann, Jr., et al.-Issued Feb. 5, 2008 Discloses snap-in veneer ties for a seismic construction system in cooperation with low-profile, high-span wall anchors.

The present invention provides an advancement in anchoring systems. The use of high-strength, compressed wire formatives at key locations in the veneer tie provides added strength in the cavity.

None of the above references provide the innovations of this invention. As will become clear in reviewing the disclosure which follows, the insulated cavity wall structures benefit from the recent developments described herein that lead to solving the problems of veneer tie interconnection failure. This invention relates to an improved anchoring arrangement for use in conjunction with cavity walls having an inner wythe and an outer wythe and meets the heretofore unmet needs described above.

SUMMARY

In general terms, the invention disclosed hereby is a high-strength veneer tie and anchoring system utilizing the same for cavity walls having an inner and outer wythe. The system includes a wire-formative veneer tie for interconnection with the wall anchor and emplacement in the outer wythe. In the disclosed system, a unique combination of an insulation protecting sheetmetal wall anchor is interconnected with a veneer tie having ribbon cavity portions. The wall anchor has an apertured receptor portion for interconnection with the veneer tie.

The veneer tie is constructed from a wire formative with an insertion portion for disposition in the outer wythe bed joint. The insertion portion has two offset legs that are optionally configured to accept a reinforcement wire for seismic applications. The insertion portion is contiguous with two ribbon cavity portions which are, in turn, contiguous with an interconnecting portion for interconnection with the wall anchor.

The veneer tie is positioned so the insertion end thereof is embedded in the outer wythe bed joint. The construction of the veneer tie results in an orientation upon emplacement so that the widest parts of the ribbon cavity portions are subjected to the highest compressive and tensile forces. The orientation of the ribbon cavity portions results in the shedding of moisture, mortar and other debris from the cavity. The outer surface of the anchor contains an aperture with predetermined dimensions to accept the veneer tie and restrict the movement of the construct, preventing veneer tie pullout.

The anchoring system of this invention is for use with varied inner wythe structures including columns with drywall thereon and masonry. The inner wythes optionally include air/vapor barriers and insulation.

It is an object of the present invention to provide in an anchoring system having an outer wythe and an inner wythe, a high-strength pullout resistant partially compressed veneer tie that interengages a wall anchor.

It is another object of the present invention to provide labor-saving devices to simplify seismic and nonseismic high-strength installations of brick and stone veneer and the securement thereof to an inner wythe.

It is yet another object of the present invention to provide a cold worked wire formative veneer tie that is characterized by high resistance to compressive and tensile forces.

It is another object of the present invention to prevent air infiltration and water penetration into and along the wall anchoring channel, while shedding excess mortar and moisture from within the cavity.

It is another object of the present invention to provide an anchoring system that maintains high insulation values.

It is a further object of the present invention to provide an anchoring system for cavity walls comprising a limited number of component parts that are economical to manufacture resulting in a relatively low unit cost.

It is a feature of the present invention that the veneer tie, after being inserted into the anchor receptor, has the cavity location oriented so that the widest portion thereof is subjected to compressive to tensile forces.

It is another feature of the present invention that the veneer ties are utilizable with either a masonry block construct having aligned or unaligned bed joints or for a dry wall construct that secures to a metal stud.

It is another feature that the anchor self-seals the insertion points thereby maintaining insulation integrity.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
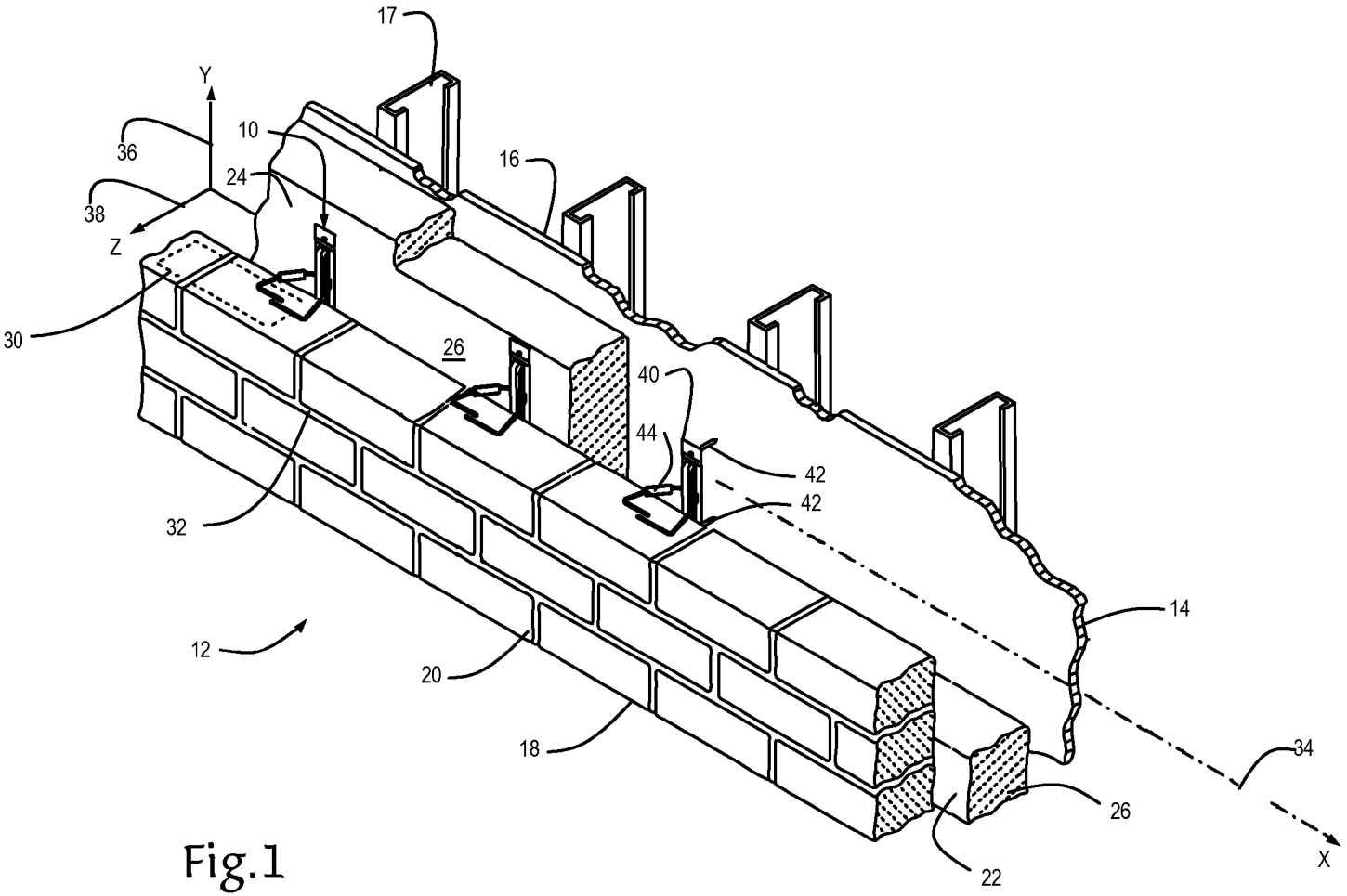
FIG. 1 is a perspective view of a high strength vertically compressed veneer tie and anchoring system of this invention and shows a wall with a drywall inner wythe with insulation disposed on the cavity-side thereof and an outer wythe of brick veneer with a detailed perspective view of the anchor set therewithin.
Figure 2:
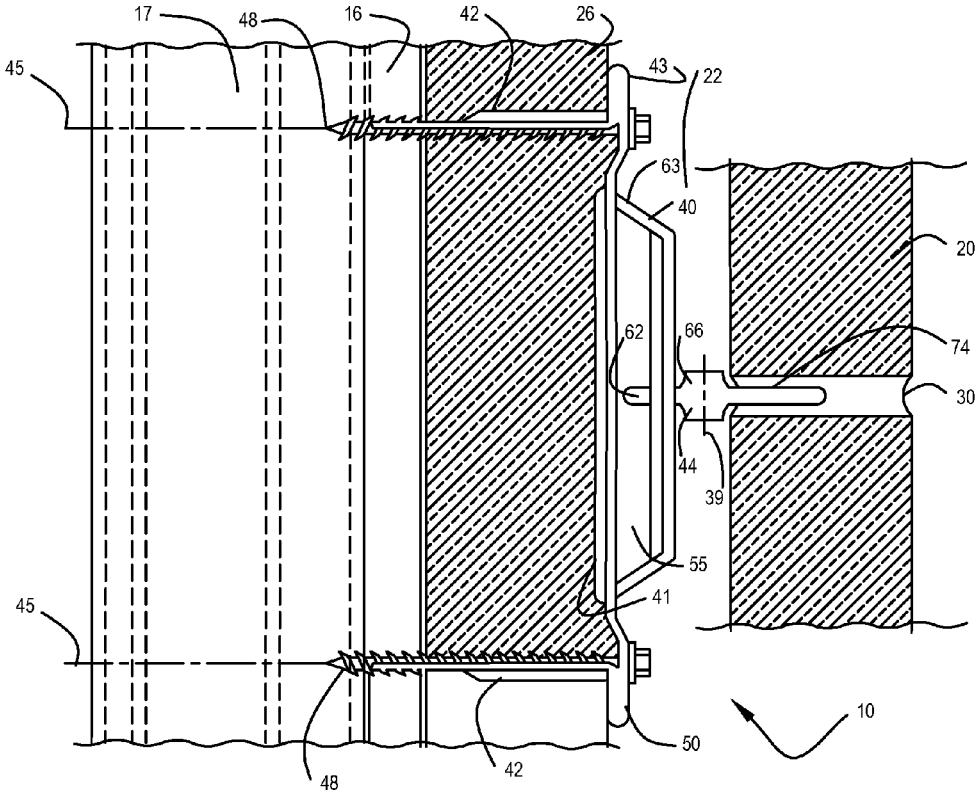
FIG. 2 is a cross-sectional view of the anchoring system of FIG. 1 with the veneer tie embedded within the outer wythe.

Before entering into the detailed Description of the Preferred Embodiments, several terms which will be revisited later are defined. These terms are relevant to discussions of innovations introduced by the improvements of this disclosure that overcome the deficits of the prior art devices.

In the detailed description below, the veneer ties are wire formatives. The wall anchors are sheetmetal constructs that protect the insulation integrity.

In the embodiments described herein the ribbon cavity portions are cold-worked or otherwise partially flattened in a north-south or vertical direction and specially configured resulting in greater tensile and compressive strength thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

For purposes of defining the invention at hand, a ribbon portion is a wire formative that has been compressed by cold working so that the resultant body is substantially semicircular at the edges and has flat surfaces therebetween. In use, the rounded edges are aligned so as to receive compressive forces transmitted from the veneer or outer wythe. In the discussion that follows the length of the ribbon cavity portions are also referred to as the major axis and the width is referred to as the minor axis. As the compressive forces are exerted on the ribbon edges, the ribbon portion withstands forces greater than uncompressed interconnectors formed from the same gage wire. Data reflecting the enhancement represented by the cold-worked ribbon portions is included hereinbelow. The nature of the cold working produces ribbon cavity portion edges within the cavity causing moisture, mortar or other debris to be shed from the veneer tie.

The description which follows is of two embodiments of anchoring systems utilizing the high-strength ribbon veneer tie devices of this invention, which devices are suitable for nonseismic and seismic cavity wall applications. Although each high-strength veneer tie is adaptable to varied inner wythe structures, the embodiments here apply to cavity walls with insulated masonry inner wythes, and to cavity walls with insulated and uninsulated dry wall (sheetrock) inner wythes.

In accordance, with the Building Code Requirements for Masonry Structures, ACI 530-05/ASCE 5-05/TMS 402-05, Chapter 6, each wythe of the cavity wall structure is designed to resist individually the effects of the loads imposed thereupon. Further, the veneer (outer wythe) is designed and detailed to accommodate differential movement and to distribute all external applied loads through the veneer to the inner wythe utilizing masonry anchors and ties.

In both the dry wall construction and in the masonry block backup wall construction, shown herein, the insulation is applied to the outer surface thereof. Recently, building codes have required that after the anchoring system is installed and, prior to the inner wythe being closed up, that an inspection be made for insulation integrity to ensure that the insulation prevents infiltration of air and moisture. The term as used herein is defined in the same sense as the building code in that, "insulation integrity" means that, after the installation of the anchoring system, there is no change or interference with the insulative properties and concomitantly that there is substantially no change in the air and moisture infiltration characteristics.

Referring now to FIGS. 1 through 5, and 10, the first embodiment of the anchoring system hereof including a high-strength vertically compressed or ribbon veneer tie of this invention is shown and is referred to generally by the number 10. A cavity wall structure 12 is shown having an inner wythe or drywall backup 14 with sheetrock or wallboard 16 mounted on metal framing members or columns 17 and an outer wythe or facing wall 18 of brick 20 construction. Inner wythes constructed of masonry materials or wood framing are also applicable. Between the inner wythe 14 and the outer wythe 18, a cavity 22 is formed. The outer wythe 18 has a facial plane or cavity surface 24 in the cavity 22.

Successive bed joints 30 and 32 are substantially planar and horizontally disposed and, in accord with current building standards, are 0.375-inch (approx.) in height. Selective ones of bed joints 30 and 32, which are formed between courses of bricks 20, are constructed to receive therewithin the insertion portion of the veneer tie hereof. Being mounted in the inner wythe, the wall anchor is supported thereby and, as described in greater detail herein below, is configured to minimize air and moisture penetration around the wall anchor/inner wythe interface.

For purposes of discussion, the cavity or horizontal surface 24 of the inner wythe 14 contains a horizontal line or x-axis 34 and intersecting vertical line or y-axis 36. A horizontal line or z-axis 38, normal to the xy-plane, passes through the coordinate origin formed by the intersecting x- and y-axes. A sheet-metal wall anchor 40 is shown with an aperture 55 in the plate-like body 50 for interconnection with a veneer tie 44.

At intervals along a horizontal surface 24, wall anchors 40 are surface mounted in the inner wythe 14. In this structure, channels sheathe the interior of the pair of fasteners or mounting hardware 48. The folded wall anchors 40 are positioned on the outer surface of insulation 26 so that the longitudinal axis of a column 17 lies within the yz-plane formed by the longitudinal axes 45 of the pair of legs 42. The wall anchors 40 have a two major faces, the mounting surface 41 and the outer surface 43. Upon insertion in the inner wythe 14, the mounting surface 41 rests snugly against the opening formed thereby and serves to cover the opening, precluding the passage of air and moisture therethrough. This construct maintains the insulation integrity. The pair of legs 42 extend from the mounting surface 41 and have the lower portion removed thereby forming notches which draw off moisture, condensate or water from the associated leg or hardware and serves to relieve any pressure which would drive toward the wallboard 16. This construct maintains the waterproofing integrity. The pair of legs 42 are substantially normal to the mounting surface 41 and the outer surface 43. An apertured receptor portion 63 is contiguous with the outer surface 43 and interconnects with the veneer tie 44. An alternative design wall anchor 40 without legs is shown in FIG. 3.

Optional strengthening ribs 84 are impressed in the wall anchor 40. The ribs 84 are substantially parallel to the apertured receptor portion 63 and, when mounting hardware 48 is fully seated so that the wall anchor 40 rests against the insulation 26, the ribs 84 are then pressed into the surface of the insulation 26. This provides additional sealing. While the ribs 84 are shown as protruding toward the insulation, it is within the contemplation of this invention that ribs 84 could be raised in the opposite direction. The alternative structure would be used in applications wherein the outer layer of the inner wythe is non-compressible and does not conform to the rib contour. The ribs 84 strengthen the wall anchor 40 and achieve an anchor with a tension and compression rating of 100 lbf.

The dimensional relationship between the wall anchor 40 and veneer tie 44 limits the axial movement of the construct. The veneer tie 44 is a wire formative metal alloy constructed of mill galvanized steel, hot-dip galvanized steel, stainless steel, bright basic steel or similar material. Each veneer tie 44 has an interconnecting portion 62 that interlocks with the apertured receptor portion 63. The apertured receptor portion or receptor 63 is constructed, in accordance with the building code requirements, to be within the predetermined dimensions to limit the z-axis 38 movement and permit y-axis 36 adjustment of the veneer tie 44. The dimensional relationship of the interconnecting portion 62 to the apertured receptor portion 63 limits the x-axis movement of the construct.

Figure 3:
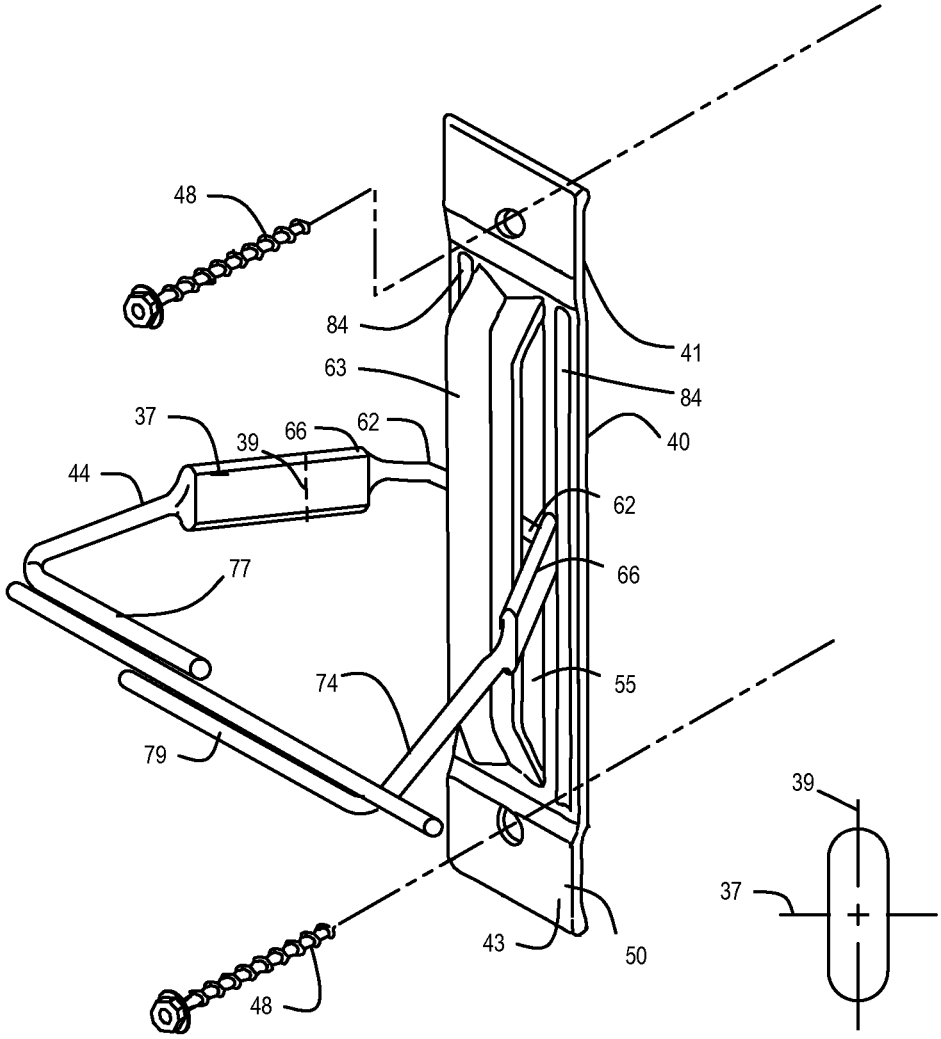
FIG. 3 is a perspective view of the veneer tie of FIG. 1 interconnected with an alternative wall anchor.
Figure 4:
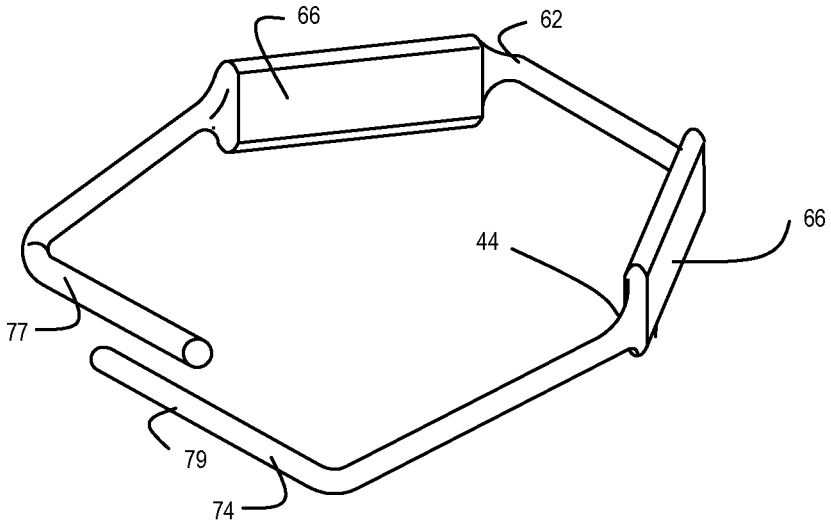
FIG. 4 is perspective view of the veneer tie of FIG. 1.
Figure 5:
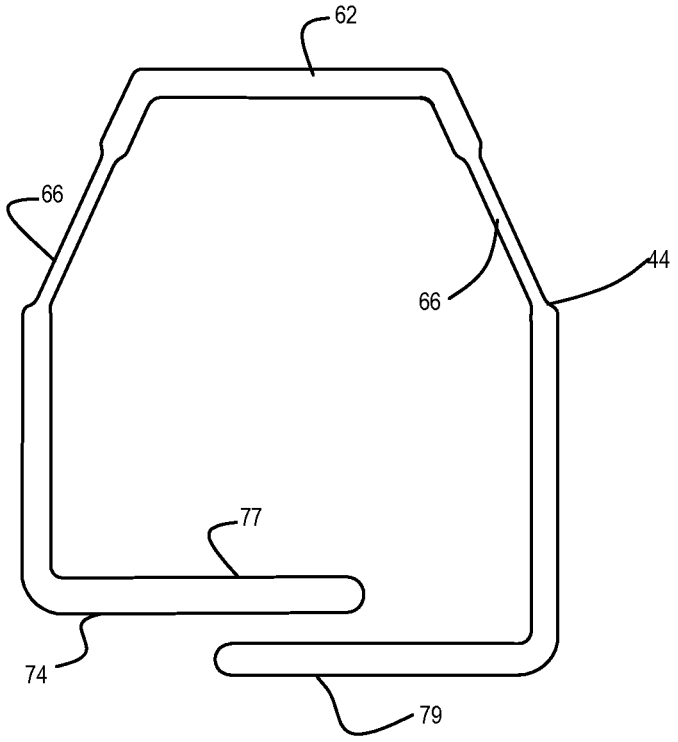
FIG. 5 is a top plan view of the veneer tie of FIG. 1.
Figure 6:
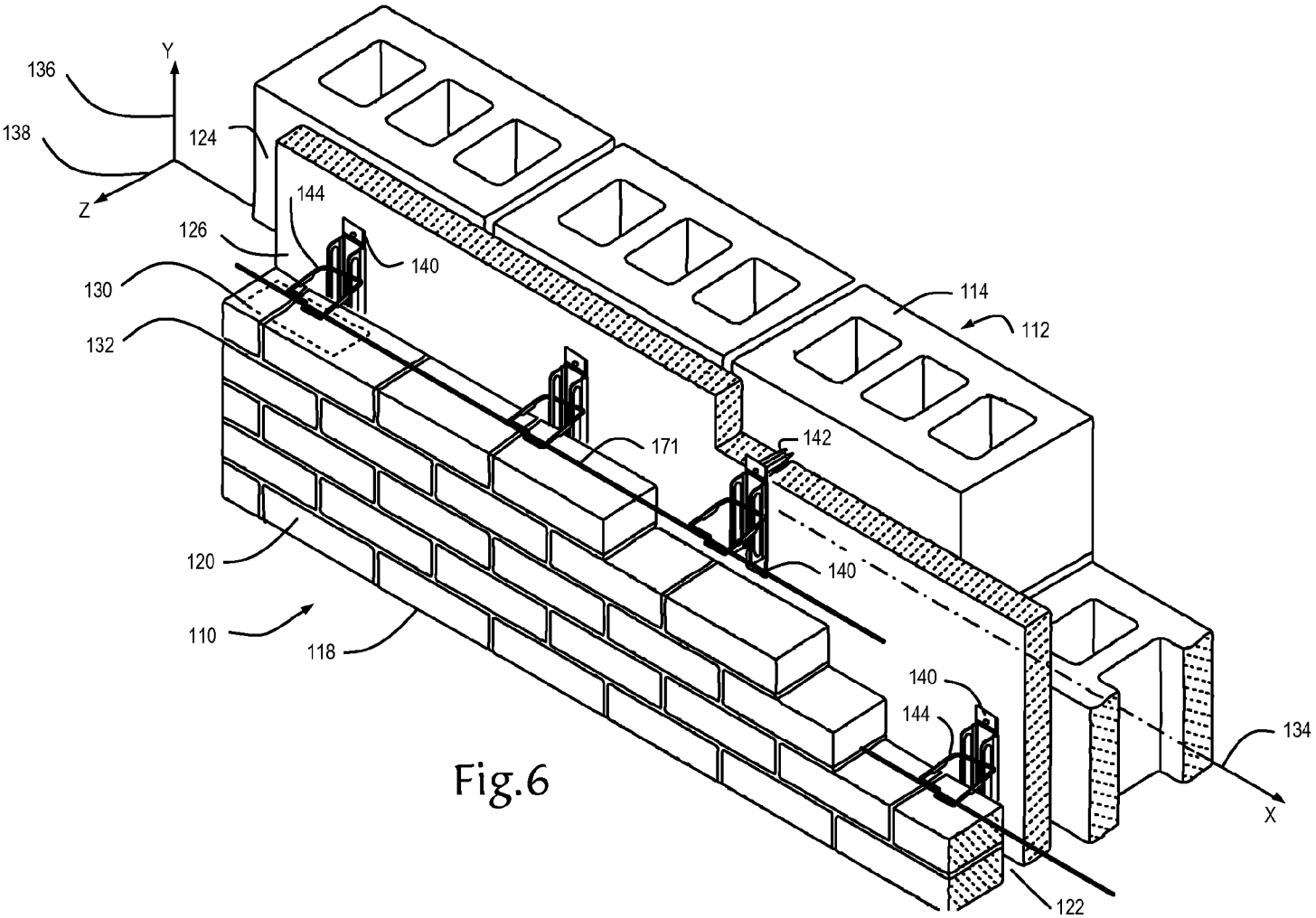
FIG. 6 is a perspective view of a high strength compressed veneer tie and anchoring system of this invention and shows the veneer tie of this invention with a reinforcement wire set therewithin and shows a wall with a masonry inner wythe with insulation thereon and an outer wythe of brick veneer.

The veneer tie 44 is more fully shown in FIGS. 3 through 5. The veneer tie 44 is a wire formative constructed from high-strength material and has an insertion portion 74 with an outer leg 79 and an inner leg 77 offset from the outer leg 79 to threadedly install the veneer tie 44 around the apertured receptor portion 63. Contiguous with the insertion portion 74 are two ribbon cavity portions 66. The veneer tie 44 has an interconnecting portion 62 that is threaded through the anchor aperture 55 to interconnect with the anchor 40. The ribbon cavity portions 66 are vertically compressed in a north-south manner and each ribbon cavity portion 66 has a major axis 39 and a minor axis 37. Upon interconnection of the veneer tie 44 with the wall anchor 40 the ribbon cavity portions 66 restrict the accumulation of mortar and debris thereon.

The ribbon cavity portions 66 are formed by compressively reducing the wire formative of the veneer tie 44. The ribbon cavity portions 66 have been compressively reduced so that, when viewed as installed, the major axis 39 of the ribbon interconnecting portion 66 is substantially perpendicular to the longitudinal axis 45 of the pair of legs 42.

The cross-sectional illustration shows the manner in which wythe-to-wythe movement is limited by the close fitting relationship between the interconnecting portion 62 and the aperture 55. The minor axis of the compressively reduced ribbon cavity portions 66 is optimally between 30 to 75% of the diameter of the 0.172- to 0.312-inch wire formative and when reduced by one-third has a tension and compression rating of at least 130% of the original wire formative material. The wire formative, once compressed, is ribbon-like in appearance; however, maintains substantially the same cross sectional area as the wire formative body.

Figure 7:
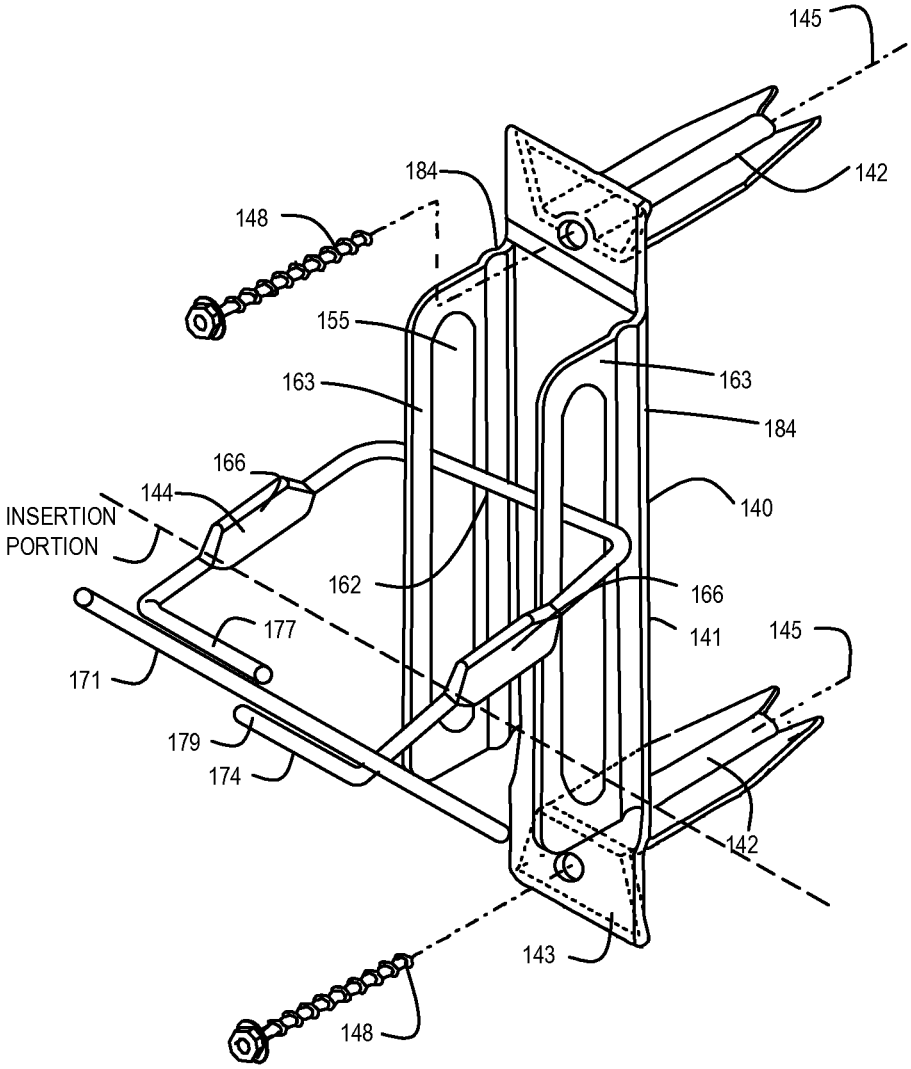
FIG. 7 is a perspective view of the veneer tie and anchor of FIG. 6 with the veneer tie having a reinforcement wire set therewithin.
Figure 8:
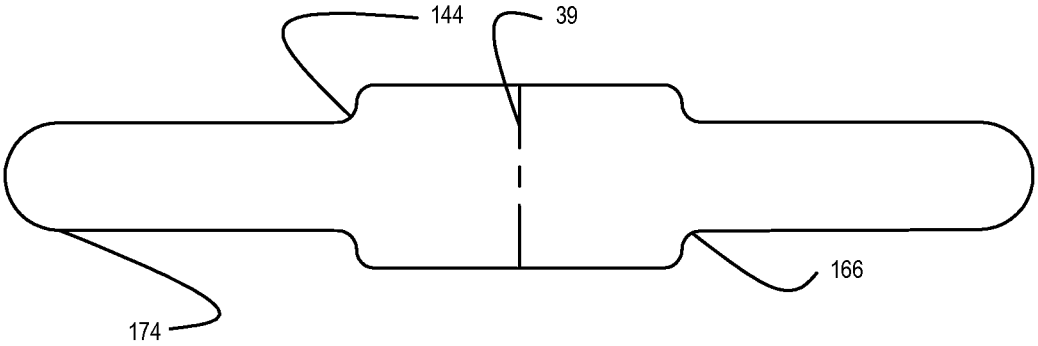
FIG. 8 is a side view of the veneer tie of FIG. 7.
Figure 9:
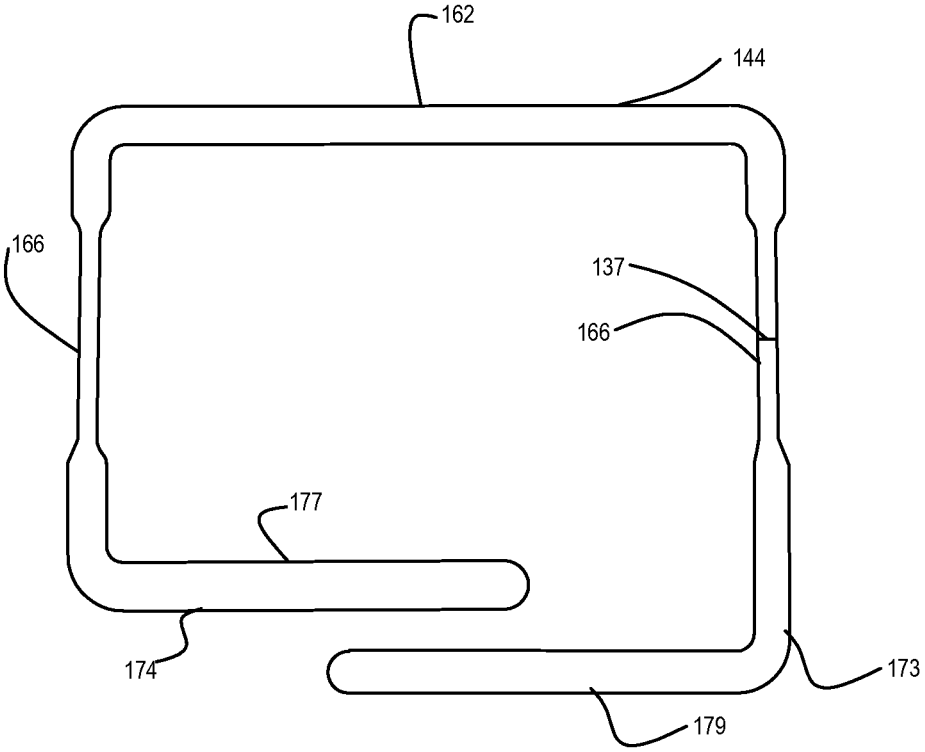
FIG. 9 is a perspective view of the veneer tie of FIG. 7.

Alternative to the wire formative veneer tie shown in FIGS. 1 through 5, the insertion portion 174 of the veneer tie 144, as shown in FIGS. 7 through 9, is optionally configured with a swaged indentation or compression 173 to accommodate therewithin a reinforcement wire or straight wire member 171 of predetermined diameter. The insertion portion 174 has a compression 173 dimensioned to interlock with the reinforcement wire 171. With this configuration, the bed joint height specification is readily maintained and the reinforcing wire 171 interlocks with the veneer tie 144 within the 0.300-inch tolerance, thereby forming a seismic construct.

The description which follows is of a second embodiment of the anchoring system hereof including a high-strength compressed veneer tie of this invention. For ease of comprehension, where similar parts are used reference designators "100" units higher are employed. Thus, the anchor 140 of the second embodiment is analogous to the anchor 40 of the first embodiment.

Referring now to FIGS. 6 through 10, the second embodiment of the anchoring system is shown and is referred to generally by the number 110. A cavity wall structure 112 is shown having an inner wythe or masonry backup 114 with rigid insulation thereon 126 and an outer wythe or veneer 118 of brick 120 construction. Between the inner wythe 114 and the outer wythe 118, a cavity 122 is formed. The outer wythe 118 has a facial plane or cavity surface 124 in the cavity 122.

Successive bed joints 130 and 132 are substantially planar and horizontally disposed in the outer wythe 118 and, in accord with current building standards, are 0.375-inch (approx.) in height. Selective ones of bed joints 130 and 132, which are formed between courses of bricks 120, are constructed to receive therewithin the insertion portion of the veneer anchor hereof. Being surface mounted in the inner wythe 114, the wall anchor 140 is supported thereby and, as described in greater detail herein below, is configured to minimize air and moisture penetration around the wall anchor/inner wythe interface.

For purposes of discussion, the cavity surface 124 of the inner wythe 114 contains a horizontal line or x-axis 134 and intersecting vertical line or y-axis 136. A horizontal line or z-axis 138, normal to the xy-plane, passes through the coordinate origin formed by the intersecting x- and y-axes. A wall anchor 140 constructed from a metal plate-like body is shown which has a pair of legs 142 that penetrate the inner wythe 114 and sheathe the mounting hardware or fasteners. Wall anchor 140 is a stamped metal construct which is constructed for surface mounting on the inner wythe 114 and for interconnection with the veneer tie 144 which, in turn, receives a reinforcement 171 therewithin.

The wall anchor is similar to that set forth in U.S. Pat. No. 7,587,874. The veneer tie 144 is shown in as being emplaced on a course of bricks 120 in preparation for embedment in the mortar of bed joint 130. In this embodiment, the system includes a wall anchor 140, veneer reinforcement 171, and a swaged veneer tie 144. The veneer reinforcement 171 is constructed of a wire formative conforming to the joint reinforcement requirements of ASTM Standard Specification A951-00, Table 1, see supra.

The wall anchor 140 is constructed from a plate-like body, which has a mounting face or mounting surface 141 and an outer face or outer surface 143. The wall anchor 140 has a pair of legs 142 extending from the mounting surface 141 which penetrate the inner wythe 114. The pair of legs 142 have longitudinal axes 145 that are substantially normal to the mounting and outer surface 141, 143. A pair of fasteners 148 are disposed adjacent to the pair of legs 142 and affix the wall anchor 140 to the inner wythe 114. At least two substantially parallel apertured receptor portions or slotted wing portions 163 are adjacent the outer surface 143 and dimensioned to interlock with the veneer tie 144 and limit displacement of the outer wythe 118 toward and away from the inner wythe 114.

The wall anchor 140 rests snugly against the opening formed thereby and serves to cover the opening, precluding the passage of air and moisture therethrough, thereby maintaining the insulation 126 integrity. It is within the contemplation of this invention that a coating of sealant or a layer of a polymeric compound—such as a closed-cell foam—(not shown) be placed on mounting surface 141 for additional sealing. Optionally, a layer of Textroseal® sealant or equivalent (not shown) distributed by Hohmann & Barnard, Inc., Hauppauge, N.Y. 11788 may be applied under the mounting surface 141 for additional protection.

In this embodiment, as best seen in FIG. 7, strengthening ribs 184 are impressed in wall anchor 140. The ribs 184 are substantially parallel to the apertured receptor portion 163 and when mounting hardware 148 is fully seated, the wall anchor 140 rests against the insulation 126. The ribs 184 strengthen the wall anchor 140 and achieve an anchor with a tension and compression rating of 100 lbf.

The legs 142 of wall anchor 140 are notched so that the depths thereof are slightly greater than the wallboard 116 and optional waterproofing membranes (not shown) thicknesses. The notch excesses form small wells which draw off moisture, condensate or water by relieving any pressure that would drive toward wallboard 116. This construct maintains the waterproofing integrity.

The veneer tie 144 is more fully shown in FIGS. 8 and 9. The veneer tie 44 shown in the first embodiment is interchangeable with those shown in this embodiment and specifically included herein. The dimensional relationship between the wall anchor 140 and veneer tie 144 limits the axial movement of the construct. The veneer tie 144 is a wire formative metal alloy constructed from mill galvanized, hot-dip galvanized, stainless steel, bright basic steel, or other similar high-strength material and has an insertion portion 174 with an outer leg 179 and an inner leg 177 offset from the outer leg 179 to threadedly install the veneer tie 144 around the apertured receptor portion 163. Contiguous with the insertion portion 174 are two ribbon cavity portions 166. The veneer tie 144 has an interconnecting portion 162 that is threaded through the anchor aperture 155 to interconnect with the anchor 140. The ribbon cavity portions 166 each have a major axis 139 and a minor axis 137. The major axis 139 of the ribbon interconnecting portion 162 is substantially perpendicular to the longitudinal axis 145 of the pair of legs 142.

The ribbon cavity portions 166 are formed by compressively reducing the wire formative of the veneer tie 144 in a vertical or north-south manner. The ribbon cavity portions 166 have been compressively reduced in a manner that restricts the accumulation of mortar and moisture thereon.

The cross-sectional illustrations show the manner in which wythe-to-wythe movement is limited by the close fitting relationship between the interconnecting portion 162 and the aperture 155. The minor axis 137 of the compressively reduced ribbon cavity portions 166 are optimally between 30 to 75% of the diameter of the 0.172- to 0.312-inch wire formative and when reduced by one-third has a tension and compression rating of at least 130% of the original wire formative material. The wire formative, once compressed, is ribbon-like in appearance; however, maintains substantially the same cross sectional area as the wire formative body.

The insertion portion 174 is optionally configured with a swaged indentation or compression 173 to accommodate therewithin a reinforcement wire or straight wire member 171 of predetermined diameter. The insertion portion 174 has a compression 173 dimensioned to interlock with the reinforcement wire 171. With this configuration, the bed joint height specification is readily maintained and the reinforcing wire 171 interlocks with the veneer tie 144 within the 0.300-inch tolerance, thereby forming a seismic construct. The anchoring system hereof meets building code requirements for seismic construction and the wall structure reinforcement of both the inner and outer wythes exceeds the testing standards therefor.

Figure 10:
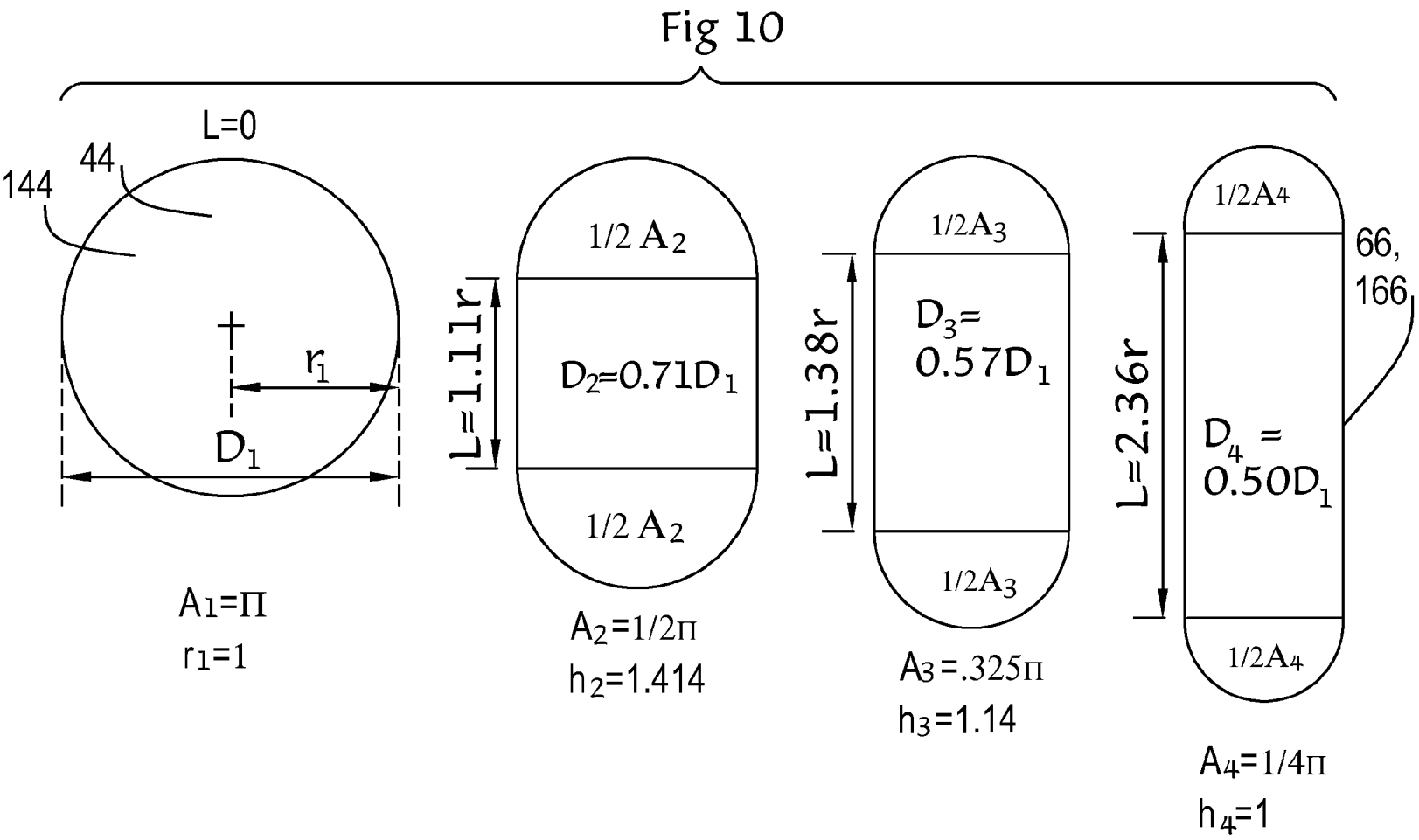
FIG. 10 is a cross-sectional view of cold-worked wire used in the formation of the compressed portions of the veneer tie hereof showing resultant aspects of continued compression.

In FIG. 10, the compression of wire formatives is shown schematically. For purposes of discussion, the elongation of the compressed wire is disregarded as the elongation is negligible and the cross-sectional area of the construct remains substantially constant. Here, the veneer tie 44, 144 is formed from 0.187-inch diameter wire and the ribbon cavity portions 66, 166 are reduced up to 75% of original diameter to a thickness of 0.113 inch.

Analytically, the circular cross-section of a wire provides greater flexural strength than a sheetmetal counterpart. In the embodiments described herein the ribbon components of the veneer tie 44 and 144 is cold-worked or partially flattened so that the specification is maintained and high-strength ribbon cavity portions 66, 166 are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 10. The deformed body has substantially the same cross-sectional area as the original wire. In each example in FIG. 10, progressive deformation of a wire is shown. Disregarding elongation and noting the prior comments, the topmost portion shows the original wire having a radius, r1=1; and area, A1=Π; length of deformation, L=0; and a diameter, D1. Upon successive deformations, the illustrations shows the area of circular cross-section bring progressively ½, % and ¼ of the area, A1, or A2=½ Π; A3=⅜ Π; and A4=¼ Π, respectively. With the first deformation, the rectangular portion has a length L=1.11r (in terms of the initial radius of 1); a height, h2=1.14; (D2=0.71D1, where D=diameter); and therefore has an area of approximately ½ Π. Likewise, with the second deformation, the rectangular portion has a length, L=1.38r; a height, h3=1.14; a diameter D3=0.57D1; and therefore has an area of approximately ⅝ Π. Yet again, with the third deformation, the rectangular portion has a length, L=2.36r; a height h4=1; a diameter, degree of plastic deformation to remain at a 0.300 inch (approx.).

In testing the high-strength veneer tie described hereinabove, the test protocol is drawn from ASTM Standard E754-80 (Reapproved 2006) entitled, Standard Test Method for Pullout Resistance of Ties and Anchors Embedded in Masonry Mortar Joints. This test method is promulgated by and is under the jurisdiction of ASTM Committee E06 on Performance of Buildings and provides procedures for determining the ability of individual masonry ties and anchors to resist extraction from a masonry mortar joint.

In forming the ribbons, the wire body of up to 0.375-inch in diameter is compressed up to 75% of the wire diameter. When compared to standard, wire formatives having diameters in the 0.172- to 0.195-inch range, a ribbon reduced by one-third from the same stock as the standard tie showed upon testing a tension and compression rating that was at least 130% of the rating for the standard tie.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength wire formative veneer tie for use with an anchoring system in a wall having an inner wythe and an outer wythe in a spaced apart relationship the one with the other and having a cavity therebetween, the outer wythe formed from a plurality of courses with a bed joint of predetermined height filled with mortar between each two adjacent courses, the veneer tie comprising:

an insertion portion for disposition in the bed joint of the outer wythe, the insertion portion having an outer leg and an inner leg offset from the outer leg;

two cavity portions contiguous with the insertion portion, each of the cavity portions comprising a ribbon cavity portion, each ribbon cavity portion being compressively reduced such that a height of each of the ribbon cavity portions is greater than a height of the insertion portion; and, an interconnecting portion contiguous with the two ribbon cavity portions and set opposite the insertion portion.

2. The veneer tie according to claim 1, wherein the height of each ribbon cavity portion is greater than a height of the interconnecting portion of the veneer tie.

3. The veneer tie according to claim 2, wherein each ribbon cavity portion is compressively reduced in such that the width of the ribbon cavity portion is smaller than a width of the insertion and interconnecting portions of the veneer tie.

4. The veneer tie according to claim 3, wherein the veneer tie outer leg has a swaged indentation for receiving a reinforcement wire.

5. The veneer tie according to claim 3, wherein each ribbon cavity portion when compressively reduced by one-third has a tension and compression rating of at least 130% of the rating for a non-reduced wire formative.

6. The veneer tie according to claim 5, wherein the veneer tie wire formative is a metal alloy constructed of material selected from a group consisting of mill galvanized steel, hot-dip galvanized steel, stainless steel, and bright basic steel.

7. A surface-mounted anchoring system for use in the construction of a wall having an inner wythe and an outer wythe, the outer wythe formed from a plurality of successive courses with a bed joint, having a predetermined height and filled with mortar, between each two adjacent courses, the inner wythe having insulation disposed thereon and in a spaced apart relationship the outer wythe forming a cavity therebetween, the anchoring system comprising:

a wall anchor adapted to be fixedly attached to the inner wythe, the wall anchor having two major faces being a mounting surface and an outer surface, the wall anchor further comprising:

a pair of legs for insertion in the inner wythe, the pair of legs extending from the mounting surface with the longitudinal axes of the pair of legs being substantially normal to the two major faces; and, at least one apertured receptor portion contiguous with the outer surface;

a wire formative veneer tie in an interlocking relationship with the apertured receptor portion, the veneer tie further comprising:

an insertion portion for disposition in the bed joint of the outer wythe, the insertion portion having an outer leg and an inner leg offset from the outer leg;

two cavity portions contiguous with the insertion portion, each of the cavity portions comprising a ribbon cavity portion, each ribbon cavity portion being compressively reduced such that a height of the ribbon cavity portion is greater than a height of the insertion portion; and, an interconnecting portion contiguous with the two ribbon cavity portions and set opposite the insertion portion.

8. The anchoring system according to claim 7, wherein the height of each ribbon cavity portion is greater than a height of the interconnecting portion of the veneer tie.

9. The anchoring system according to claim 8, wherein the width of each ribbon cavity portion is smaller than a width of the insertion and interconnecting portions of the veneer tie.

10. The anchoring system according to claim 9, wherein the height of each ribbon cavity portion is substantially perpendicular to the longitudinal axis of the pair of legs.

11. The anchoring system according to claim 10, wherein each ribbon cavity portion is compressively reduced in thickness by up to 75% of the original diameter thereof.

12. The anchoring system according to claim 11, wherein each ribbon cavity portion is 0.172- to 0.312-inch diameter wire.

13. The anchoring system according to claim 12, wherein each ribbon cavity portion is reduced by one-third and has a tension and compression rating at least 130% of the rating for a non-reduced wire formative.

14. The anchoring system according to claim 13, wherein the veneer tie outer leg further comprises:

a swaged indentation for receiving a reinforcement wire; and, a reinforcement wire disposed in the indentation;

whereby upon insertion of the reinforcement wire in the indentation a seismic construct is formed.

15. The anchoring system according to claim 14, wherein the veneer tie wire formative is a metal alloy constructed of material selected from a group consisting of mill galvanized steel, hot-dip galvanized steel, stainless steel, and bright basic steel.

16. The veneer tie according to claim 1, wherein the height of each ribbon cavity portion is greater than a height of a remainder of the veneer tie.

17. The veneer tie according to claim 1, wherein the height of each ribbon cavity portion is greater than a width of the ribbon cavity portion.

18. The anchoring system according to claim 15, wherein the wall anchor comprises two substantially parallel apertured receptor portions.

19. The anchoring system according to claim 15, wherein the wall anchor further comprises at least one strengthening rib constructed to meet a 100 lbf. tension and compression rating.

20. The anchoring system according to claim 19, wherein each strengthening rib is impressed to depend from the mounting surface and configured, upon surface mounting of the wall anchor, to be pressed into the insulation of the inner wythe.

* * * * *